US007325500B2

(12) United States Patent
Carpenter et al.

(10) Patent No.: US 7,325,500 B2
(45) Date of Patent: Feb. 5, 2008

(54) PACKAGING SYSTEM, APPARATUS, AND METHOD WITH ARTICULABLE CORNER SUPPORT MEMBERS

(76) Inventors: Gary Carpenter, 1744 Auburn Dr., Carrollton, TX (US) 75007; Robbie Rex Powell, P.O. Box 117690, Carrollton, TX (US) 75011

( * ) Notice: Subject to any disclaimer, the term of this patent is extended or adjusted under 35 U.S.C. 154(b) by 332 days.

(21) Appl. No.: 10/860,518

(22) Filed: Jun. 3, 2004

(65) Prior Publication Data

US 2005/0028710 A1 Feb. 10, 2005

Related U.S. Application Data

(63) Continuation-in-part of application No. 10/637,220, filed on Aug. 8, 2003.

(51) Int. Cl.
*B65D 19/00* (2006.01)

(52) U.S. Cl. ..... 108/51.11; 108/51.13

(58) Field of Classification Search ..... 108/51.11, 108/51.3, 57.75, 193, 55.1, 56.1, 180
See application file for complete search history.

(56) References Cited

U.S. PATENT DOCUMENTS 2,503,240 A * 4/1950 Cahners ..... 108/51.3
3,026,078 A * 3/1962 Simkins ..... 108/51.3
3,581,681 A 6/1971 Newton
3,613,605 A 10/1971 Holdredge, Jr.
3,667,403 A 6/1972 Angelbeck, Jr.
3,710,733 A 1/1973 Story
3,719,157 A 3/1973 Arcocha et al.
3,911,834 A * 10/1975 Quaintance ..... 108/51.3
3,951,078 A 4/1976 Fowler et al.
4,244,471 A * 1/1981 Plante ..... 206/586
4,339,039 A 7/1982 Mykleby
4,467,728 A 8/1984 Horne
4,482,054 A 11/1984 Gardner
4,483,444 A 11/1984 Gardner
4,507,348 A * 3/1985 Nagata et al. ..... 108/57.25
4,630,550 A * 12/1986 Weitzman ..... 108/155
4,759,295 A * 7/1988 Nilsen et al. ..... 108/51.3
4,809,618 A 3/1989 Bell
4,851,286 A 7/1989 Maurice
4,906,510 A * 3/1990 Todor et al. ..... 108/51.3
5,139,153 A 8/1992 Delamare et al.
5,267,651 A 12/1993 Hughes
5,476,048 A 12/1995 Yamashita et al.
5,505,141 A 4/1996 Barber
5,593,039 A 1/1997 Ortlieb
5,690,037 A * 11/1997 Hill ..... 108/51.3
5,845,588 A 12/1998 Gronnevik (Continued)

*Primary Examiner*—Jose V. Chen
(74) *Attorney, Agent, or Firm*—Schultz & Associates, P.C.

(57) ABSTRACT

A system for use in the packing of an appliance containing the pallet and corner members is provided. The pallet comprises first and second support members and a connecting cross member, wherein the cross member is substantially perpendicular to the first and second support members. The first and second support members include attachment holes, wherein the attachment holes allow for the attachment of the pallet to the appliance. The first and second support members and the cross member are manufactured from a synthetic substance and are substantially hollow. The system further comprises an available plurality of articulable corner support members, corner junction end caps with tenons, closed cell design elements, and standoffs used to protect, support, separate and/or stabilize the appliance in a container.

30 Claims, 14 Drawing Sheets

U.S. PATENT DOCUMENTS 5,876,813 A 3/1999 Bambara et al.
5,921,187 A * 7/1999 Wang ..... 108/51.3
5,937,767 A 8/1999 Togawa et al.
5,947,037 A * 9/1999 Hornberger et al. ..... 108/115
6,059,104 A 5/2000 Widman
6,155,527 A 12/2000 Muyskens
6,186,329 B1 2/2001 Qiu
6,234,314 B1 5/2001 Qiu et al.
6,247,596 B1 6/2001 Muyskens
6,286,683 B1 9/2001 Hunt et al.
6,352,039 B1 3/2002 Woods et al.
6,513,662 B1 2/2003 Stebelton
6,595,367 B2 7/2003 Baechle
6,883,882 B2 * 4/2005 Lin ..... 108/193

* cited by examiner

PACKAGING SYSTEM, APPARATUS, AND METHOD WITH ARTICULABLE CORNER SUPPORT MEMBERS

CROSS-REFERENCE TO RELATED APPLICATIONS

This application is a Continuation-in-Part of U.S. application Ser. No. 10/637,220, filed Aug. 8, 2003.

BACKGROUND

The present invention is related to a packaging system, and more particularly to a synthetic packaging system for supporting appliances.

Packaging pallets are typically made of wood and are commonly constructed using a box frame with deck boards attached to form a flat surface. Wood pallets perform the desired function however; the wood pallets add excessive weight and cost and are environmentally wasteful. A manufacturer's goods are then placed upon the flat surface of the pallet for transport. Pallets are designed to allow for ease of transportation and allow for movement through the use of mechanical means such as a forklift. However, a manufacturer must account for the additional costs associated with the additional delivery weight of a pallet and packaging.

Plastic pallets have been developed to meet some of the shortcomings of wood pallets. An example of such a pallet is described in U.S. Pat. No. 6,352,039 entitled "Plastic Pallet," issued to Woods, et al. The plastic pallet includes a frame and deck boards attached to the frame without the use of mechanical fasteners. A second example is shown in U.S. Pat. No. 3,581,681 entitled "Pallet," issued to Newton. In the Newton patent, a pallet constructed of a thin-walled, resinous shell filled with a foam core bonded to the inside surface of the shell. The shell of the Newton pallet includes integral support beams spaced appropriately to accommodate a forklift. The Newton pallet is constructed to meet basic strength requirements at a low cost.

A benefit of transporting goods attached to pallets is that the pallet can provide protection from external elements. An example of such a system is shown in U.S. Pat. No. 4,244,471 entitled "Packaging System," issued to Plante. In the Plante packaging system, top and bottom caps for packaging appliances are shown. The top and bottom caps are attached via a plurality of corner angles extending vertically between the top and bottom caps. The corner angles have a length greater than the height of the appliance so that a space exists between the appliance and the top cap. The packaging system is rigid and thus allows multiple systems to be placed upon each other.

Pallets are also used in the manufacture of appliances. The base of the appliance is fixedly attached to the pallet before construction. The pallet is moved down an assembly line via a conveyor belt or other transportation system and the appliance is constructed on the base. Once construction is completed, the remaining packaging is attached to the pallet and the appliance is then transported to its destination. The remaining packaging system often includes a cardboard box that fits over the appliance. Often the corners of the cardboard box are reinforced with a light metal, Styrofoam, corrugated or paperwrap corners.

SUMMARY OF THE INVENTION

Generally, the present invention provides a packing system for use with the transportation and manufacture of an appliance, such as refrigerators, ranges and the like. The system comprises a pallet, fixed corner and edge support members, articulable corner and edge support members, and spacing members. In the preferred embodiment, these members can be fitted into corrugated or non-corrugated cardboard boxes or other containment devices and can be used in combination or individually. The pallet system comprises support members and connecting cross members, wherein the cross members are substantially perpendicular to the support members. The first and second support members include attachment holes, wherein the attachment holes allow for the attachment of the pallet to the appliance. The first and second support members and cross members are manufactured from a synthetic substance and are substantially hollow. The corner support members, fixed and articulable, are used for reinforcement of the corners of a cardboard box container, or the like, and for protection of the corners and edges of the appliance. The corner support members can be manufactured in a plurality of various shapes, lengths, and sizes for specific applications. In addition, the conformable corner support members are provided to be user adapted to fit various corner shapes from about 90 degrees to about 180 degrees in shape design. Also, the articulable corner support members can be user adapted to form a plurality of lengths and widths of numerous sizes and shapes of products. The articulable members further allow for ease in storage because of their ability to be stacked and stocked in a generally flat configuration. The spacing members are used to exact proper lateral positioning of the appliance in the cardboard box and to protect various protrusions on the appliance from damage.

A system according to the preferred embodiment of the invention reduces the weight, costs of the packaging and can be recycled. Another advantage of the disclosed invention is the reduction of damage to the system by outside elements. For instance, pallets made according to the invention do not absorb moisture and odors and do not disintegrate after exposure to such elements.

The present invention's articulable corner/edge support member apparatus comprises a plurality of substantially hollow members formed through the extrusion of a plastic material, or the like, having top, bottom, and side surfaces. It will be understood by those skilled in the art that the apparatus can be formed in a plurality of geometric shapes, including, but not limited to, circles, octagons, triangles, squares, rectangles, and ovals wherein a top, bottom, and side surface is merely a descriptive reference point and is a relative description of any specific portion which the designer chooses to reference as a top, bottom, or side surface. For example, a circle can have a top, bottom, and side as defined by the designer.

The apparatus is manufactured in a generally 3-D planar fashion having a horizontal shaped channel portion that is formed during the extrusion process along the longitudinal centerline of a surface, preferably the top surface of the plastic material, wherein the combination of the horizontal channel and a hingeable base formed by the horizontal channel allows the plastic material to conformably articulate along the hingeable base to adapt to a plurality of acute and obtuse angles, while yet remaining resiliently attached along the hingeable base axis. The articulable corner/edge support member further comprises at least one longitudinal interlocking groove along at least an upper portion of a wall of the horizontal channel and in parallel relationship with the hingeable base.

In addition to the interlocking groove is provided at least one accompanying reciprocal longitudinal interlocking ridge hook member along at least an upper portion of the opposite wall of the horizontal V-shaped channel in a direct mirror positional relationship to the female interlocking groove so as when the articulable corner support member is articulated along the hingeable base in an acute angle approaching 90 degrees the two walls of the horizontal V-shaped channel come into contact. Upon a slight applied pressure, the ridge hook and groove combination will cause the articulable corner support member to interlock in an approximate 90 degree position, therein causing the corner/edge member to remain in the interlocked position until a force is applied causing separation.

In another embodiment, the present invention further comprises an articulable corner support member as in the previous embodiment but further having at least one V-shaped notch cut and removed entirely through the top, side, and bottom surfaces and along a vertical axis and in perpendicular relationship to the longitudinal horizontal V-shaped channel, wherein the base axis of the vertically cut V-shaped notch is in close proximity to the upper surface portion of at least one wall of the longitudinal horizontal V-shaped channel. The articulable corner support member of further having at least one V-shaped heat impression formed into the top surface of the articulable corner support by heat impression tool and die techniques, wherein the impression is formed on the opposite top surface as compared to the vertically cut V-shaped notch described above. The combination of the vertically cut V-shaped notches and the V-shaped heat impressions allow for a 3-D generally planar corner support member to be articulated along the notches, channels, and impressions to thereby form a plurality of 3-D corner support members with the ability to further adaptively form a plurality of rectangle/square sizes.

In yet another embodiment of the present invention is presented an articulable corner support member having at least two substantially hollow rectangular pieces formed by extrusion process of a plastic material, or the like, and having a linking plastic portion extruded so as to hingeably attach the substantially hollow pieces at opposing upper corner junction regions, thereby enabling both support members to hinge at either or both hingeable junction regions to conformably adapt to a plurality of corner/edge surfaces.

In another embodiment, the present invention presents closed cell design element members for use in a plurality of packaging systems and configurations. The closed cell design element member comprises at least two hollow geometric closed cell design elements formed from a plastic material and connected by a plastic connecting beam element. The closed cell elements comprise a plurality of geometric shapes, lengths and sizes to accommodate numerous packaging scenarios and various appliance shipping configurations. Closed cell design elements of a particular member can be formed having the same, different, or combination of geometric shapes on each design element member. The plastic connecting beam element provides stability and integrity of the plurality of elements while positioned in the shipping container or box. The closed cell element members can be formed to serve as corner supporting members or to provide a plurality of partitioned areas for safe separation and protection of a plurality of appliances within a container.

In still another embodiment, the invention provides for a joinable end cap extruded so as to removably unite the ends of the fixed and articulable corner support members. The end caps are formed to provide an interlocking frictional action imparted by horizontal tenon-like extensions that protrude from the end cap's exterior top surface and are inserted into the hollow ends of the rigid and/or articulable corner support members. When four end caps are used with the embodiments above a formed rectangle/square can be rigidly and removably united. The use of the end caps ensures structural integrity of the formed shape. The use of one end cap with the third embodiment will provide rigid and removable union of the opposing ends of the formed rectangle shape.

Accordingly, it is an object of the present invention to provide a plurality of devices and methods of a packing system for use with the transportation and manufacture of various appliances and the like. Another object is to reduce the weight and cost of appliance packaging and to provide for a material that can be successfully recycled. Another object is to provide easily storable articulable corner support members that allow the user to adapt the members from a flat configuration into a 3-D corner adaptation and to further allow the corner support members to be shaped into a plurality of rectangular/square sizes to accommodate various appliance sizes.

BRIEF DESCRIPTION OF THE DRAWINGS

For a more complete understanding of the present invention, and for further details and advantages thereof, reference is now made to the following Detailed Description taken in conjunction with the following drawings, in which.

DETAILED DESCRIPTION

Figure 1:
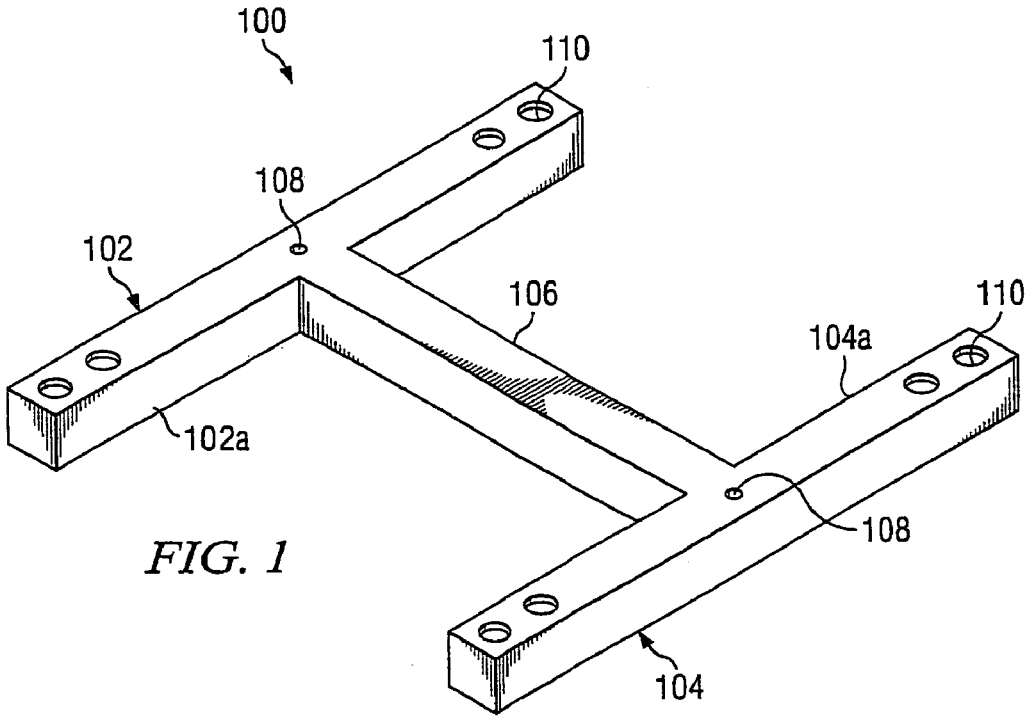
FIG. 1 is an isometric view of a pallet according to the invention.

In the descriptions which follow, like parts may be marked with the same numerals. The drawing figures are not necessarily drawn to scale and certain figures may be shown in exaggerated or generalized form in the interest of clarity and conciseness.

In accordance with a broad aspect of the invention, the packing system and articulable corner support members of the present invention are designed for multi-uses but are specifically referred to herein as being used with the transportation and manufacture of household type appliances. It is understood that the spirit of the present invention provides for uses beyond just household appliances. To accomplish the previous objectives, the present invention contemplates the use of an appliance type pallet formed of a plastic material and having support and cross members for lateral support and stability. The invention allows for an appliance to be attached to the pallet after the appliance has been manufactured. Alternatively, the appliance can be built directly on top of the disclosed pallet frame and disconnected and removed upon delivery to the customer.

In addition to the pallet are provided corner support members for further protecting the appliance during at least the transportation phase. The present invention provides for pre-formed rigid plastic corner support members that are formed into the "corner shape" during the extrusion process. These rigid corner support members are easily inserted at each corner between the appliance and the box containing the appliance. Additionally provided by the present invention are articulable corner support members formed in a substantially flat configuration and having a longitudinal V-shaped channel allowing the user to hingeably adapt the articulable corner support members manually into a desired corner angle before inserting into the shipping container. This ability to adapt to a flat configuration when not in use provides for ease of storage of large quantities of the articulable members.

Each specific embodiment of the invention will now be described in greater detail.

Figure 2:
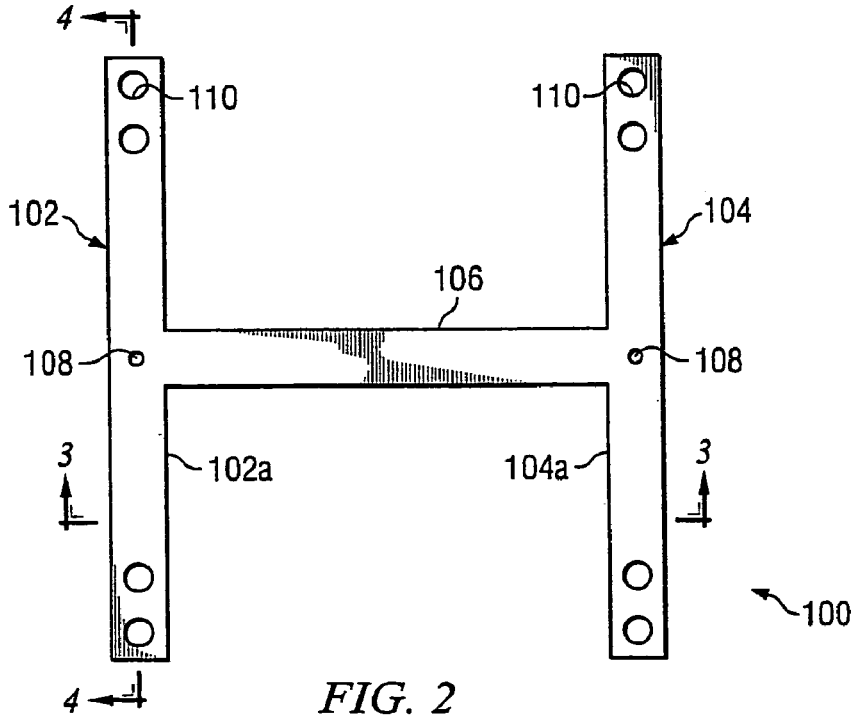
FIG. 2 is a plan view of a pallet according to the invention.

Referring now to FIGS. 1 and 2, an appliance pallet is shown. An "H" shaped pallet 100 includes support members 102 and 104 connected by a cross member 106 which is substantially perpendicular to the support members 102 and 104. The interior sides 102*a* and 104*a* of support members 102 and 104 are connected to the cross member 106. Pallet 100 can be manufactured as a single piece or can be assembled from multiple, separate pieces. Pallet 100 can be cast or extruded or cast pieces can be assembled to form the pallet. Assembly techniques for plastic elements are known to those skilled in the art and can include adhesives, inductive welding or physical connectors such as pop rivets or other methods known in the art. In one disclosed embodiment the pallet is formed from plastic, such as High Density Polyethylene (HDPE), however a wide variety of materials may be used to form the pallet, including, but not limited to, HIPS, LDPE, polypropylene, polyethelene and Crosslink PE. The thickness of the walls of the support members and cross members in the preferred embodiment is between 0.010-0.100 of an inch in thickness.

Pallet 100 includes bolt holes 108. Bolt holes 108 are designed to allow for various appliances to be directly attached to the pallet. Retaining bolts are placed through the holes and into an appliance to secure the pallet to the appliance. Adhesive attachment can also be used as can removable straps. Also included are feet holes 110 for placement of feet of appliance. Once the appliance (not shown) is attached to pallet 100, which in one disclosed embodiment includes bolts, the H shaped pallet 100 and the appliance can be moved as a single piece. A wide variety of attachment mechanisms can be implemented without detracting from the spirit of the invention.

In another embodiment, the frame of the appliance (not shown) can be attached to the pallet at the beginning stages of manufacture of the appliance. The appliance frame and the pallet are then moved along an assembly line allowing the appliance to be completed while attached to the pallet. The appliance and the pallet can then be packaged for shipment after completion of the appliance. A wide variety of appliances can be attached to the pallet, including as examples computers, ranges, washing machines, refrigerators and dish washers.

In another embodiment (not shown), the pallet 100 extends beyond the edges of the appliance and includes corners with extend up the edges of the appliance. In this embodiment the pallet is not necessarily attached to the appliance.

Figure 3:
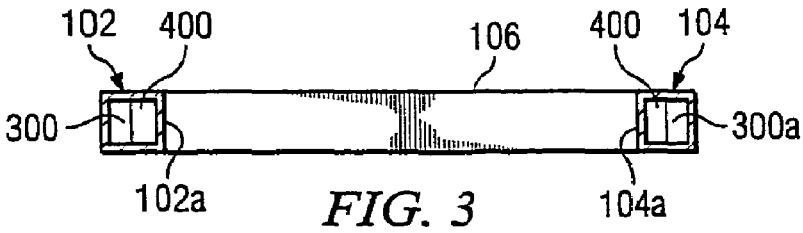
FIG. 3 is a section view through line 3 of a pallet according to the invention.
Figure 4:
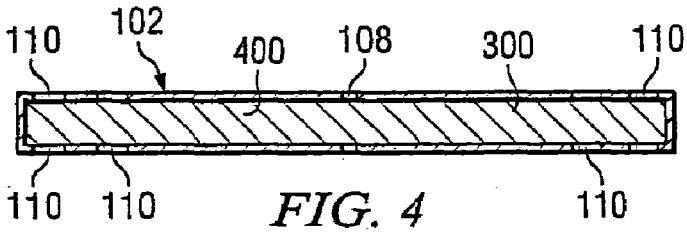
FIG. 4 is a section view through line 4 of a pallet according to the invention.

The interior views of the support members 102 and 104 are shown in FIGS. 3 and 4. In FIG. 3, a cross sectional view through line 3 of FIG. 2 is shown. In FIG. 4, a cross sectional view through line 4 of FIG. 2 is shown. The support members 102 and 104 are shown forming hollow spaces 300 and 300*a*. The cross-sectional shapes formed by the support members 102 and 104 are substantially square. However, various cross-sectional shapes can be implemented without detracting from spirit of the invention, including but not limited to rectangular, oval, and circular. The hollow spaces 300 and 300*a* can remain hollow, can be filled with a rigid or flexible plastic foam substance to enhance strength, or can include an interior support, such as those shown in FIG. 4 and in FIGS. 5A-5D. The wall thickness of the support members 102 and 104 can be varied to allow for weight differences of the varying appliances. For example, a greater wall thickness can be implemented for heavy cold storage devices.

Cross member 106 is shown attached to support members 102 and 104. In one embodiment, the cross member 106 is manufactured with a smaller cross-sectional area than either of the support members 106. In this embodiment, the cross member 106 provides support to the support members 102 and 104 but does not directly bear the weight of the appliance. The cross member 106 increases the stiffness of the pallet and reduces the level of deflection under torsional loads. In another embodiment, the cross member 106 cross-sectional area is equal to the cross-sectional areas of the support members 102 and 104. In this embodiment, the cross member 106 provides support to the support members 102 and 104 and can be implemented to bear some of the weight of the appliance. In another embodiment, cross member 106 is attached to support members 102 and 104 at interior sides 102*a* and 104*a*. In another embodiment, the cross member 106 is attached to either the top or bottom surface of the support members 102 and 104.

FIG. 4 shows a support member 102 with an offset channel rib 400. Offset channel rib 400 is offset from center and vertically extends the length of support member 102. More than one offset channel rib 400 can be located in support member 102 offset from channel rib 400 to provide additional strength to the support member 102 without incurring substantial increases in weight and costs.

Figure 5A:
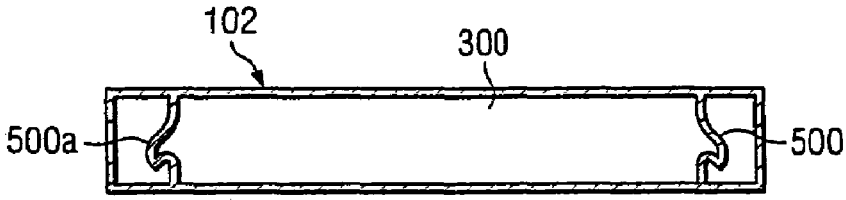
FIGS. 5A-D are section views of support members according to alternate embodiments of the invention.

FIGS. 5A-5D show various internal support structures. Support member 102 may be formed without support structures but may also include them. FIG. 5A shows a cross-section of support member 102 including wave supports 500 and 500*a*. Wave supports 500 and 500*a* are located in the hollow space 300. The wave supports 500 and 500*a* provide additional strength without incurring substantial increases in weight and costs.

Figure 5B:
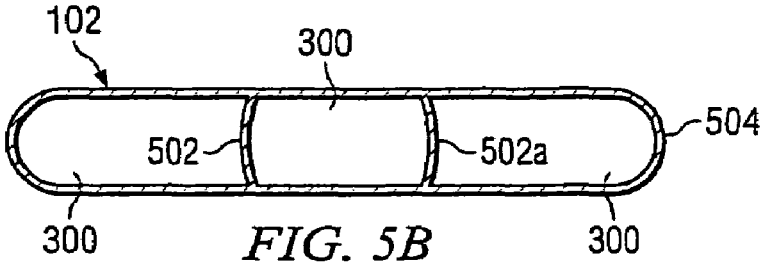

In FIG. 5B, an alternate interior support structure is shown. Support member 102 includes a rounded edge 504. The oval hollow space 300 includes interior support structures 502 and 502*a*. The interior support structures 502 and 502*a* of the preferred embodiment are curved. The curved interior support structures 502 and 502*a* provide additional strength without incurring substantial increases in weight and costs.

Figure 5C:
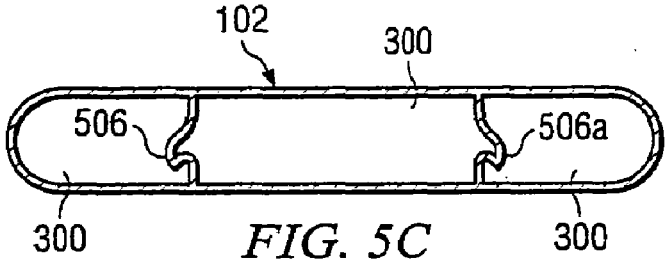

In FIG. 5C, the wave support structures 506 and 506*a* are shown in an oval hollow space 300. In this embodiment, the wave support structures 506 and 506*a* are located nearer the center of the cross-sectional area of the support member 102. The location of the support structures in the hollow space 300 can be varied to accommodate different stiffness levels and to accommodate the varying weights of different appliances, however, various other locations are possible.

Figure 5D:
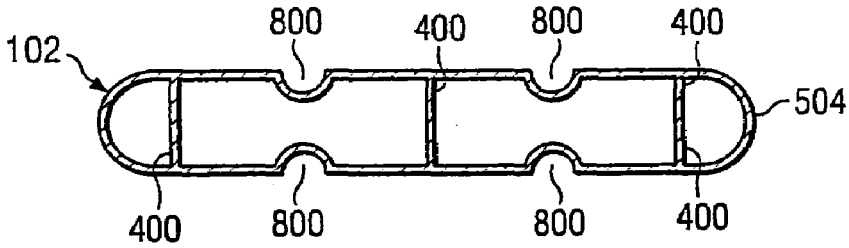

FIG. 5D shows an alternate cross-section of support member 102. The outside profile of support member 102 may have one or more saddle regions 800 for lateral support. Support member 102 is shown having three offset channel ribs 400. Other embodiments could have more or fewer internal support structures of various shapes as previously described.

Figure 6:
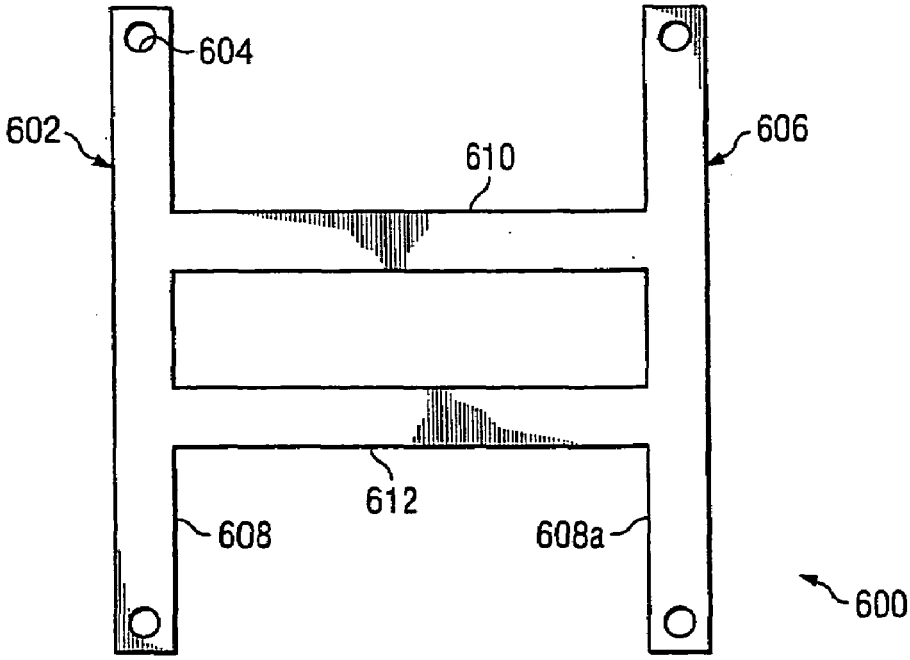
FIG. 6 is a plan view of a pallet according to an alternate embodiment of the invention.

In FIG. 6, an alternate embodiment of a pallet of the invention is shown. Dual cross member pallet 600 includes support members 602 and 606. The support members 602 and 606 are connected with cross members 610 and 612. The cross members 610 and 612 are attached at the interior sides 608 and 608*a* of the support members 602 and 606. Bolt holes 604 are shown in the support members 602 and 606 and can be used to attach the dual cross member pallet 600 to an appliance. In this embodiment two cross members 610 and 612 are shown, however, multiple cross members can be used.

Figure 7:
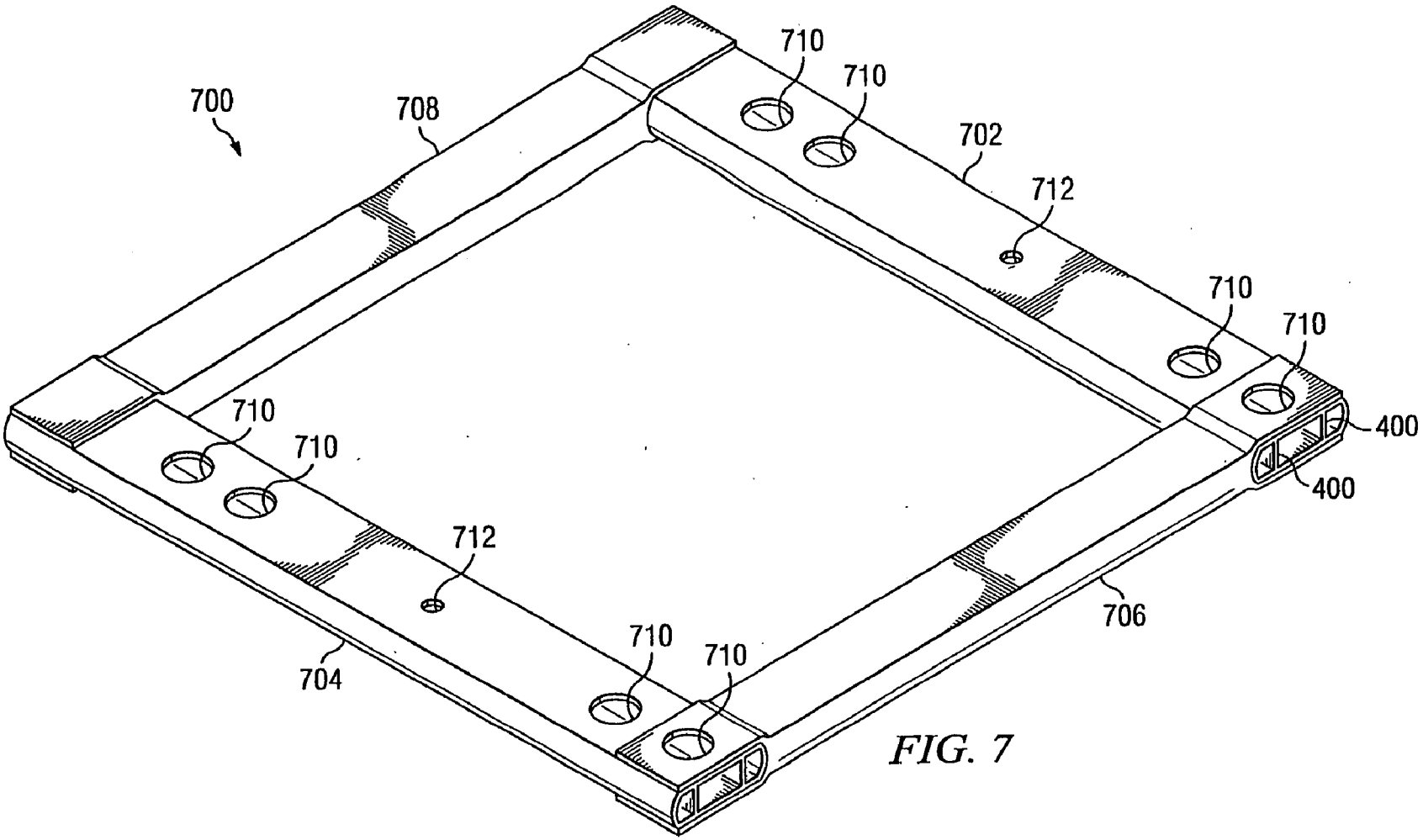
FIG. 7 is an isometric view of a pallet according to an alternate embodiment of the invention.

In FIG. 7, an alternate embodiment of the pallet of the invention is shown. A square pallet 700 includes support member 702 and 704. The support members 702 and 704 are connected with cross members 706 and 708. Cross members 706 and 708 are attached at the ends of support members 702 and 704. Cross members 706 and 708 and support members 702 and 704 may have alternate cross-sections such as those shown in FIGS. 5A-5D. Bolt holes 712 are shown in support members 702 and 704 and can be used to attach square pallet 700 to an appliance with retaining bolts. Also, appliance feet holes 710 may be located in support members 702 and 704 and cross members 706 and 708 to accommodate feet found on the appliance.

Figure 8A:
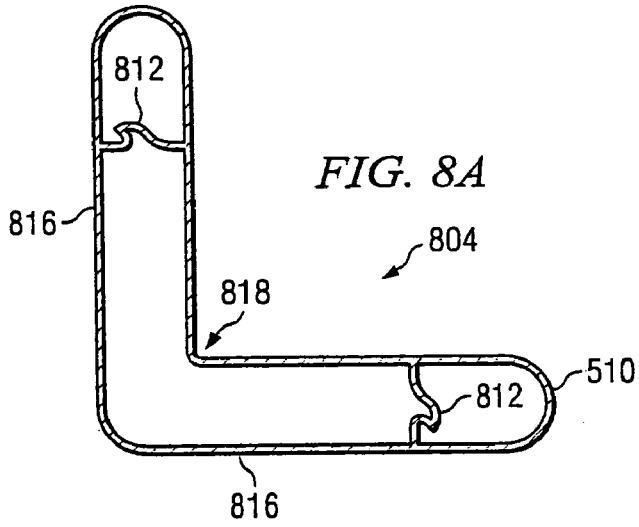
FIGS. 8A-C are section views of corner support members according to alternate embodiments of the invention.
Figure 8B:
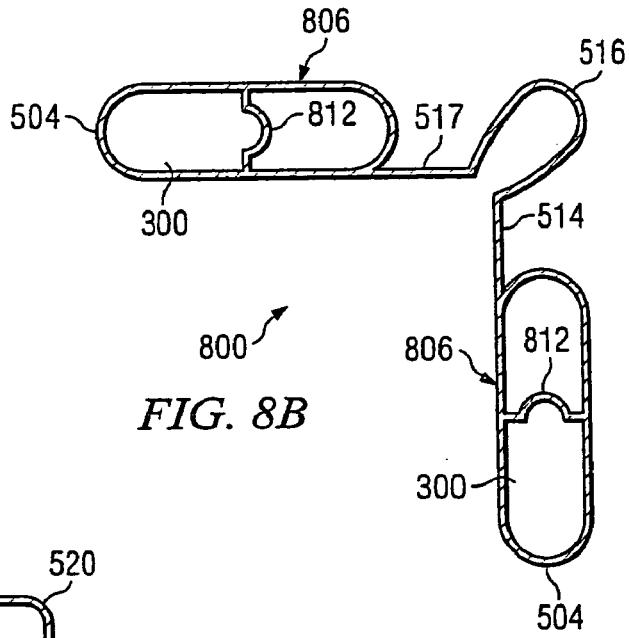
Figure 8C:
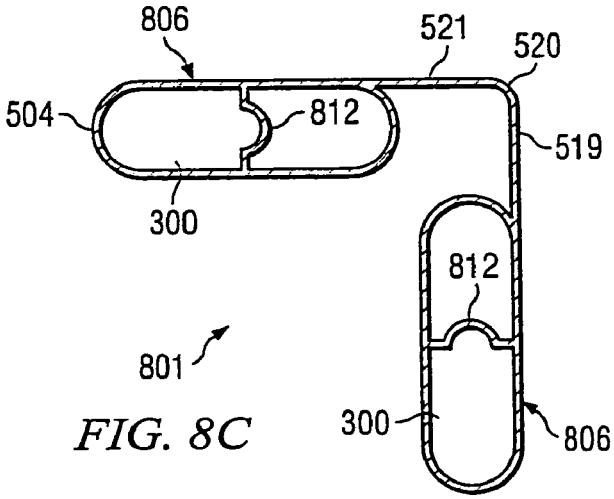

Once the appliance is fully constructed and ready to be shipped, a cardboard box can be secured around the appliance to protect the appliance during transport. The cardboard box can be corrugated or non-corrugated. FIGS. 8A-C show alternate corner support member structures designed to be inserted in or near the corners of the cardboard box.

FIGS. 8A-C show cross-sections of the alternate corner support member structures. The structures of the preferred embodiment are extended to a predetermined length with a constraining cross section. The cross section includes internal support members 812. Curved internal support members 812 provide additional strength to the corner support member during use without incurring substantial increases in weight and expense. Also, during manufacture after the corner support member has been extruded and is cooling, internal support members 812 add support to the pliable walls until the walls can cool and strengthen. The internal support members 812 may be straight or have a curved profile. The corner support members may not have any internal support members or may have one or more internal support members depending on the type of internal support desired.

The alternate corner support member structures are formed from plastic, such as High Density Polyethylene (HDPE), however a wide variety of manufacturing materials may be used to form the support member structures without detracting from the spirit of the invention, including, but not limited to, HIPS, LDPE, polypropylene, polyethelene and Crosslink PE. The preferred thickness of the walls of the corner support member structures, such as internal support members 812, is between 0.010 and 0.100 of an inch in thickness.

In FIG. 8A, corner support member 804 has an upper case "L" profile having extensions 816 and corner 818. In use, corner 818 fits next to a corner edge of the appliance extending along and overlapping the corner of the appliance to protect it from damage and secure it during transport.

In FIGS. 8B and 8C, alternate embodiments of the corner support members are shown. In FIG. 8B, corner support member 800 includes individual support lobes 806 connected by beam 514, loop 516 and beam 517. The support lobes are substantially tubular members which are held at positions approximately perpendicular to each other by beam 514, loop 516 and beam 517. Loop 516 provides shock resistance to impact loads directed towards the corners of the appliance. In FIG. 8C, corner support member 801 includes support lobes 806 connected by beam 519, corner 520 and beam 521.

Figure 9A:
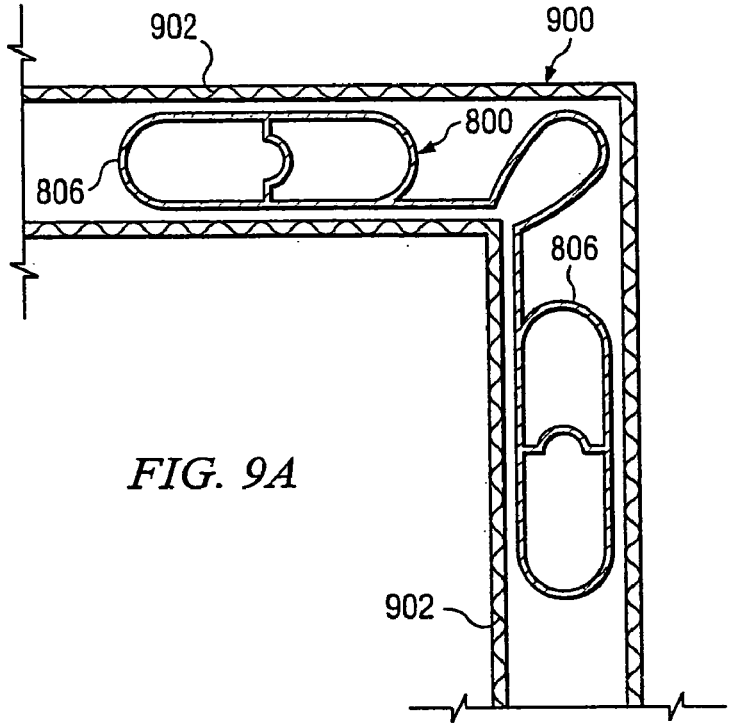
FIGS. 9A-B are section views of corner support members in use.
Figure 9B:
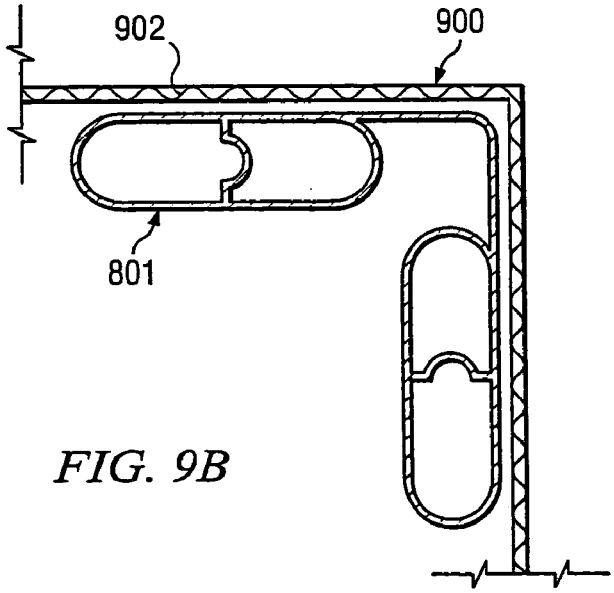

The various corner support structures shown in FIGS. 8A-C can be contained within the walls of or proximate to an interior wall of a cardboard box or packing container. For example, FIG. 9A shows corner support member 800 inside the walls 902 of a packing box 900. FIG. 9B shows the corner support member 801 proximate to an interior wall 902 of a packing box 900. The corner support member structures can vary in height, length, and dimensions and can be positioned in the top corners, bottom corners, or side corners of the shipping container depending on the desired cost, stacking strength, horizontal cushioning, vertical cushioning and corner cushioning desired.

In FIGS. 10A-D, alternate embodiments of a wall spacing member are shown. The wall spacing member is a special type of corner support structure which extends past an outside wall of the appliance and contacts the inside wall of the container surrounding the appliance. The purpose of the wall spacing members is to form a standoff to distance the container from protrusions such as handles, knobs or display panels that extend past the outside wall, top or bottom of the appliance.

Figure 10A:
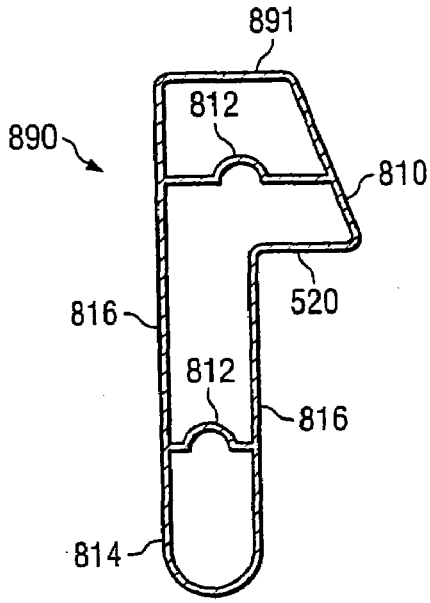
FIGS. 10A-D are section views of wall spacing members according to alternate embodiments of the invention.

Referring to FIG. 10A, a wall spacing member 890 is shown whose cross section includes a head section 810, a placement surface 891, and a tail section 814. The tail section contains two walls 816 separated by an internal support member 812. The length of walls 816 extend to head section 810. Head section 810 includes an internal support member 812 and is formed with a notch 520. In use, notch 520 makes contact with the edge of an appliance while placement surface 891 contacts the inside of the container. Head section 810 forms a spacer for the protrusions of the appliance. The distance the head section 810 extends past the wall of the appliance depends on the profile of head section 810.

Figure 10B:
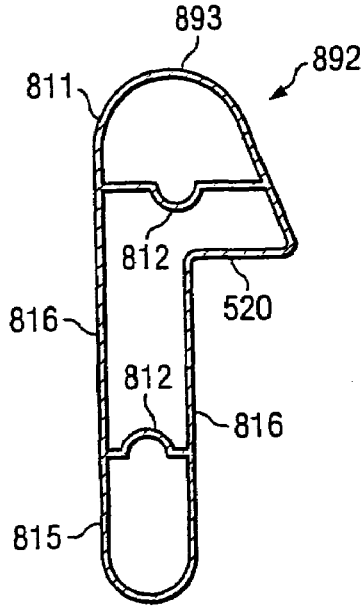

Referring to FIG. 10B, wall spacing member 892 is shown with a cross section that has a head section 811 and a tail section 815. The tail section contains two walls 816 separated by an internal support member 812. Head section 811 includes an internal support member 812 and is formed with a notch 520. Notch 520 makes contact with the edge of an appliance, while placement surface 893 contacts the inside of the packing box 900. Placement surface 893 is curved to accommodate different types of packing containers. Head section 811 forms a spacer for the protrusions of the appliance.

Figure 10C:
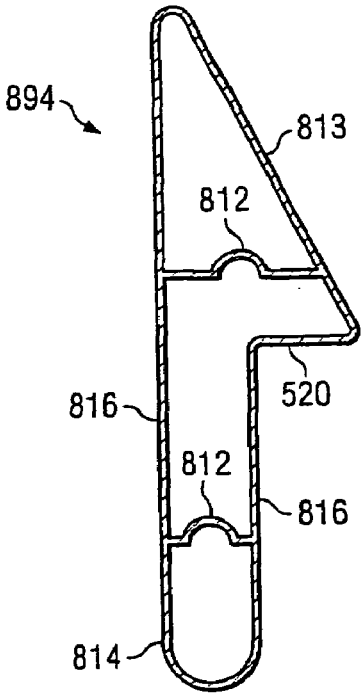

Referring to FIG. 10C, a spacing member 894 is shown with a cross section that has a triangular head section 813. Triangular head section 813 accommodates different types of packing containers.

Figure 10D:
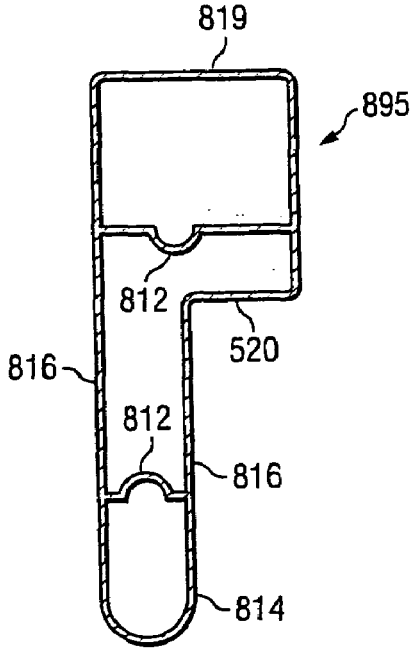

Referring now to FIG. 10D, a wall spacing member 895 is shown that has a head section 819. Head section 819 is formed in the shape of a square in order to accommodate different types of packing containers.

FIGS. 10A and 10B show a relatively small head profile wherein head section 810 would extend a relatively short distance from the walls of the appliance. The wall spacing members shown in FIGS. 10A and 10B would be used for protrusions such as knobs or dials. The wall spacing members shown in FIGS. 10C and 10D would be used for larger protrusions such as handles.

Figure 11A:
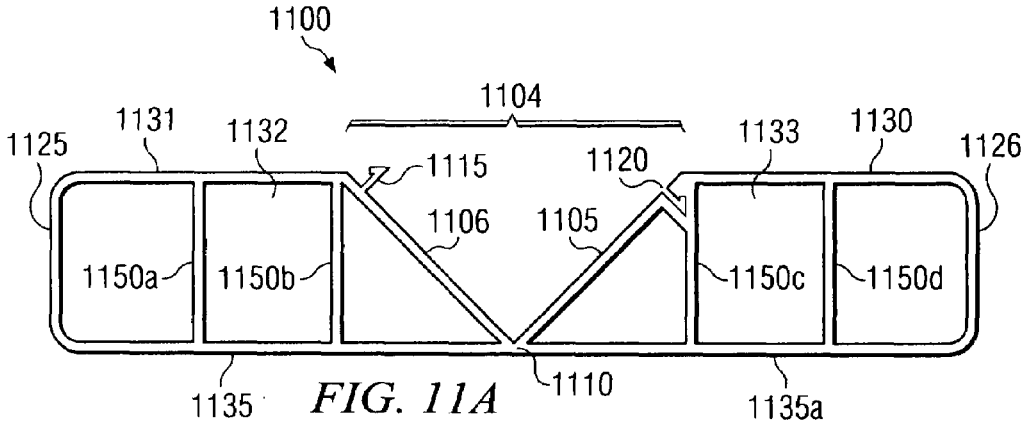
FIG. 11A is a section view of a 3-D articulable corner support member in a flat unarticulated configuration depicting an interlocking mechanism according to an embodiment of the invention.
Figure 11B:
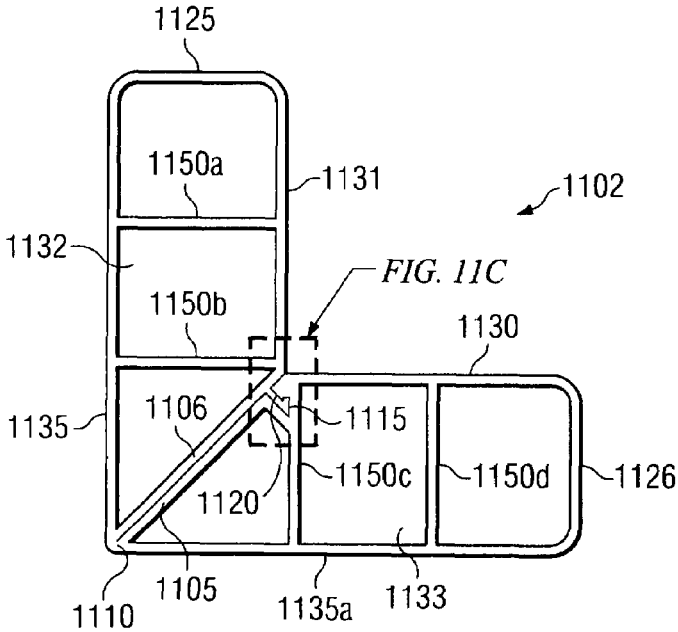
FIG. 11B is a section view of a 3-D articulable corner support member of FIG. 11A in an articulated and locked configuration according to an embodiment of the invention.
Figure 11C:
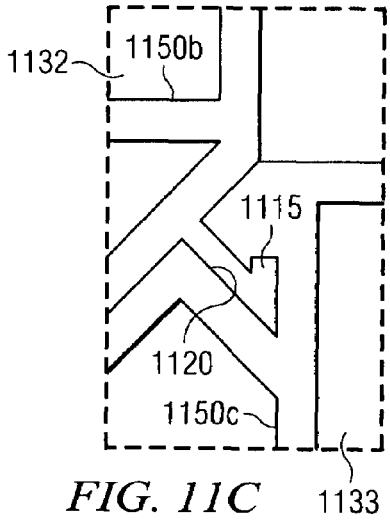
FIG. 11C is a close-up view of the locking interconnections shown in FIG. 11B in a locked configuration of according to an embodiment of the invention.
Figure 11D:
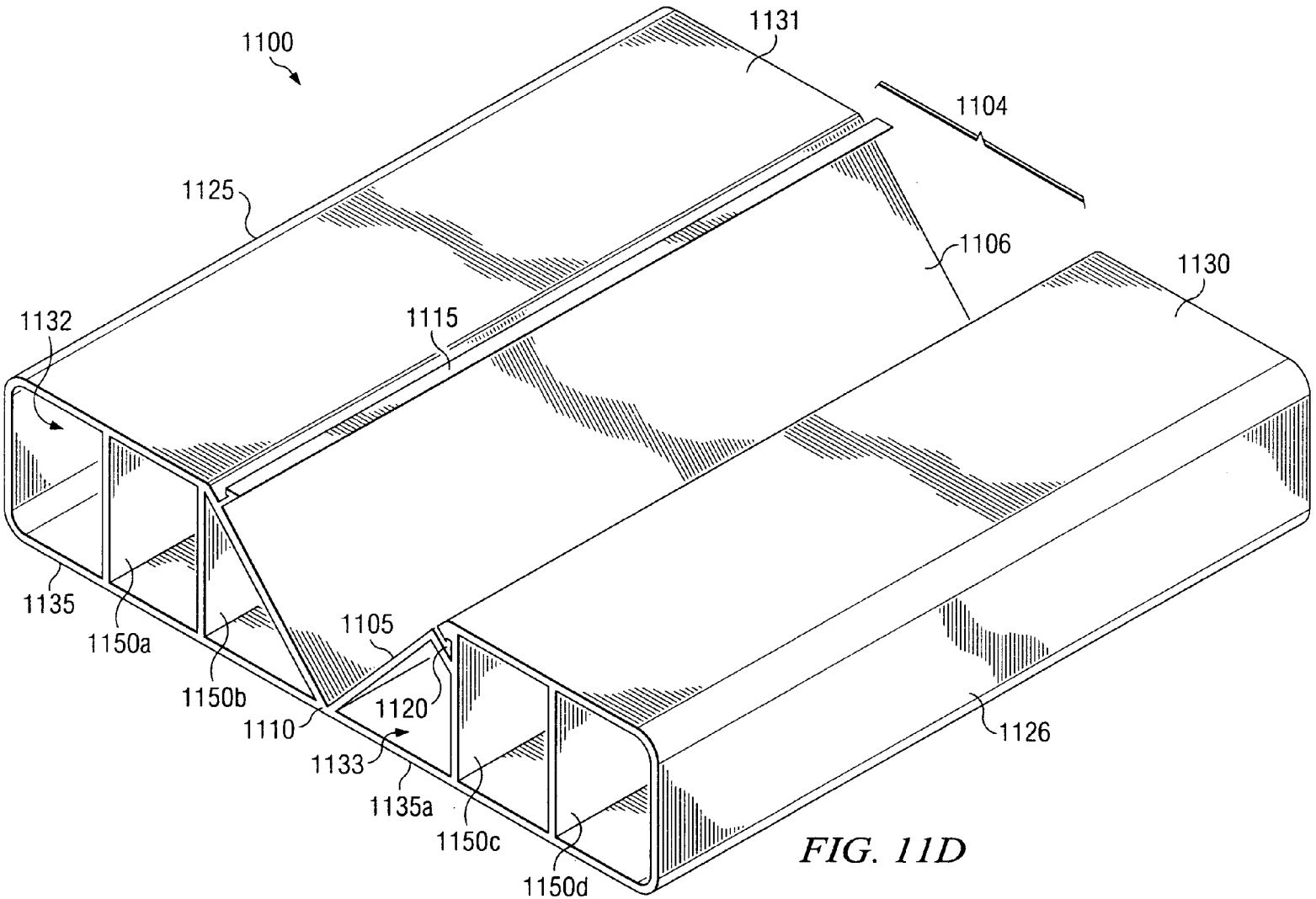
FIG. 11D is an isometric view of a 3-D articulable corner support member in a flat unarticulated configuration according to an embodiment the invention.

Referring now to FIGS. 11A through 11D, an articulable corner/edge support member is shown in both its un-articulated flat configuration 1100 (FIG. 11A) and after being articulated and snapped into an interlocking hinged 3-D configuration 1102 (FIG. 11B). The articulable corner/edge support member shown comprises at least two substantially hollow support lobe members 1132, 1133 extruded from a plastic material in various lengths, or the like, having top 1130, 1131, bottom 1135, 1135*a*, and side 1125, 1126 surfaces and formed in a generally planar fashion. It will be understood by those skilled in the art that the articulable apparatus can be formed in a plurality of geometric shapes, including, but not limited to, circles, octagons, triangles, squares, rectangles, and ovals wherein a top, bottom, and side surface reference is merely a descriptive reference point and is a relative description of any specific portion to which the designer chooses to reference as the top, bottom, or side surface. For example, a circle can have a top, bottom, and side as defined by the designer for a specific purpose.

The hollow lobe members 1132, 1133 are provided internal support by use of vertical supports 1150*a*, 1150*b*, 1150*c*, and 1150*d* disposed within the hollow lobe members. The supports 1150*a*, 1150*b*, 1150*c*, and 1150*d* can be any shape including, but not limited to, a straight or wave design. As depicted, supports 1150*c* and 1150*d* attach in a linking relationship the inner-side of top surface 1130 to the inner-side of bottom surface 1135*a*. Similarly, supports 1150*a* and 1150*b* attach in a linking relationship the inner-side of top surface 1131 to the inner-side of bottom surface 1135.

The hollow lobe members are designed for articulation about an approximate center point of bottom surfaces 1135 and 1135*a* along hingeable base center axis 1110 by fashioning a horizontal channel portion 1104 with opposing sidewalls 1105, 1106. The channel portion 1104 can be formed during the extraction process to be a V-shaped channel, a contoured U-shaped channel, a square U-shaped channel, or any other desirable shape. The sidewalls 1105, 1106 are formed during extrusion along the longitudinal centerline of the top surface of the plastic material. As can be seen in FIG. 11*b*, the combination of the horizontal V-shape channel 1104 and the hingeable base center axis 1110 allows the corner/edge support member 1100, to conformably articulate along the hingeable base 1110 to adapt to a plurality of angles while yet remaining resiliently attached along the hingeable base axis 1110.

In continued reference to FIGS. 11A through 11D, the articulable corner/edge support member 1100 further comprises at least one interlocking groove 1120 along at least a portion of at least the longitudinal upper portion of one wall 1105 of the horizontal channel 1104 and in approximate parallel relationship with the hingeable base axis 1110. Further provided is at least one accompanying and reciprocally positioned interlocking ridge hook 1115 that is disposed along at least an upper portion of the opposite wall 1106 of the channel, in relation to the groove 1120, so as when the corner/edge support member is articulated along the hingeable base 1110 to form an acute angle approaching 90 degrees the two walls of the horizontal channel come into interlocking contact. It will be understood by those skilled in the art that other interlocking ridge and groove combinations can be utilized without departing from the present invention.

Specifically referring to FIG. 3C is shown a close-up view of the locking interconnection of FIG. 11B. Upon application of a slight pressure, the ridge hook 1115 and groove 1120 combination of the corner support member will interlock in an approximate 90 degree position, as shown by 1102 of FIG. 11B, therein causing the corner/edge member 1102 to remain in the interlocked position. The corner/edge support member 1102 will remain in an interlocked articulated position until a slight separation force is applied, thereby causing disconnection of the two substantially hollow support lobe members 1132, 1133 at the interlocking groove 1120 and ridge 1115 interconnects.

Figure 12A:
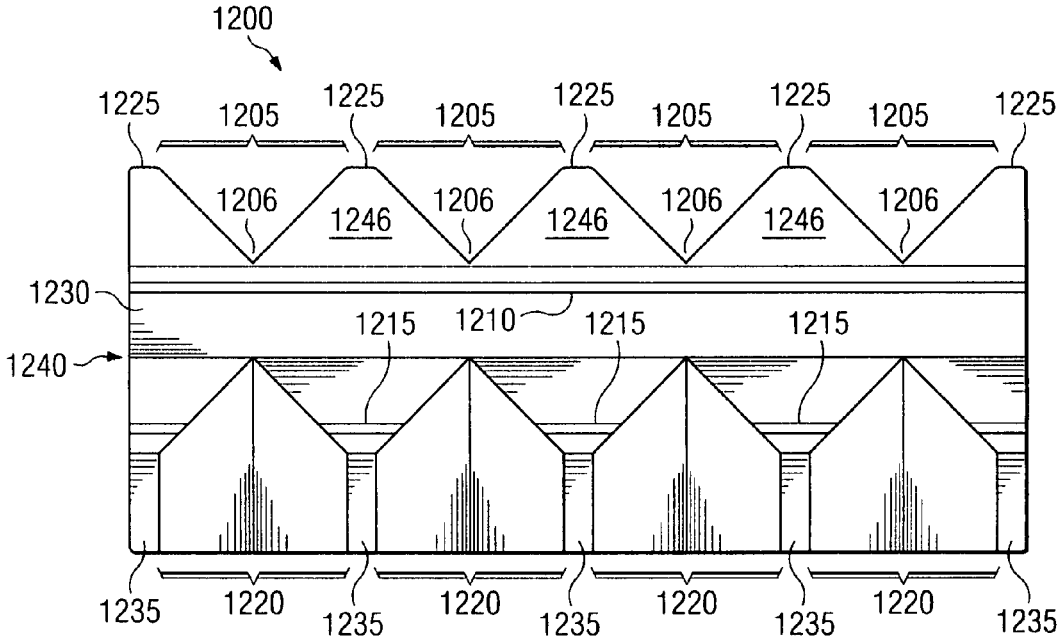
FIG. 12A is a plan view of a 3-D articulable corner support member having vertical axis V-shaped notches and opposing horizontal axis V-shaped heated impressions for forming rectangles/squares.
Figure 12C:
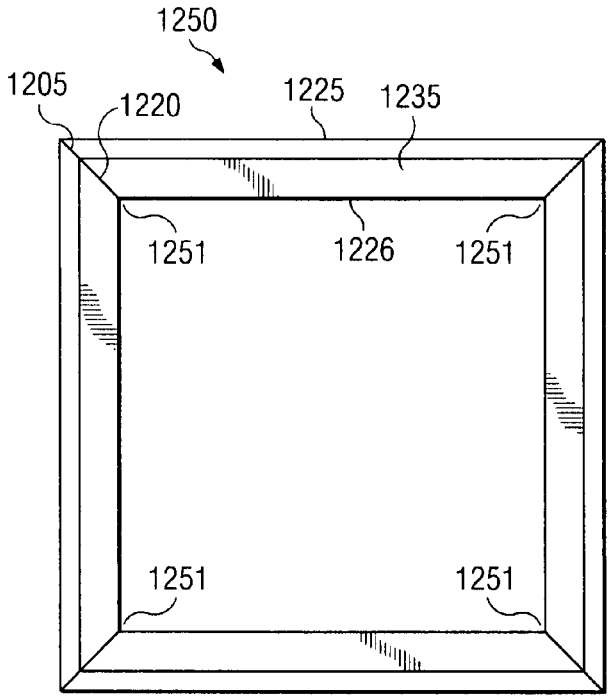
FIG. 12C is a plan view of FIGS. 12A & 12B after being configured into a rectangle/square.
Figure 12B:
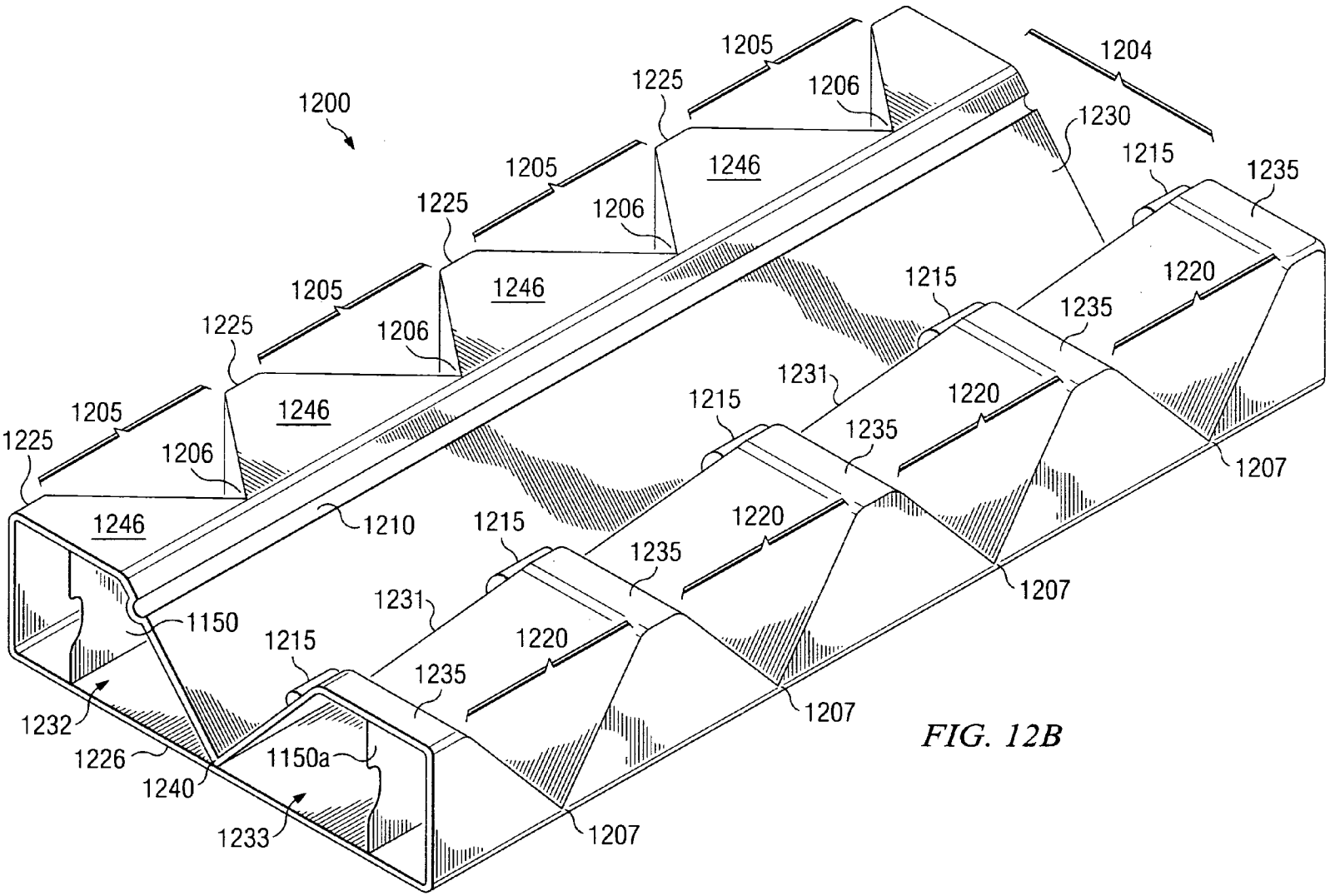
FIG. 12B is an isometric view of the 3-D articulable corner support member of FIG. 12A.

FIGS. 12A-12C show another embodiment of an articulable corner support member 1200 having at least two substantially hollow support lobe members 1232, 1233 and wave supports 1150 and 1150*a*. Articulable corner support member 1200 provides for articulation about at least 3 separate axes 1206, 1220, and 1240. This embodiment comprises an articulable corner support member as in FIG. 1B but further comprising a plurality of V-shaped notches 1205 cut entirely through the top 1246, side 1225, and bottom 1226 surfaces along a vertical axis of substantially hollow support lobe member 1232 and in perpendicular relationship to longitudinal horizontal V-shaped channel 1204 having hingeable base axis 1240. Once the V-shaped notches are cut as described the cutout remainder is removed and discarded. Base axis 1206 of vertically cut V-shaped notch 1205 is in close proximity to the upper surface portion of at least one wall 1230 of the longitudinal horizontal V-shaped channel 1204 that separates substantially hollow support lobe members 1232, 1233.

FIG. 12B shows an isometric view of the articulable corner support member 1200 of FIG. 12A. This embodiment further comprises a plurality of V-shaped heat impression troughs 1220 pressed into top surface 1235 of substantially hollow lobe 1233 of the corner support 1200 by heat impression tool and die techniques. Heat impression trough 1220 is formed in the opposite top surface 1235 and perpendicular to vertically cut V-shaped notch 1205 (cut through surface 1246) described above. The combination of the vertically cut V-shaped notches 1205, the V-shaped longitudinal channel 1204 and base axis 1240, and the V-shaped heat impressions 1220 allow for a generally planar corner support member to be articulated along the notches, channels, and impressions to thereby form a plurality of 3-D corner support members with the ability to further adaptively form a plurality of rectangle/square sizes as shown in FIG. 12C.

The embodiment shown FIG. 12B further comprises at least one female interlocking groove 1210 along at least a longitudinal upper portion of one 1230 (in support lobe member 1232) of horizontal V-shaped channel 1204 and in parallel relationship with a hingeable base axis 1240. The embodiment depicted in FIG. 12B further comprises at least one interlocking ridge 1215 that is disposed along at least an upper portion of wall 1231 of V-shaped channel 1204 in direct a opposing mirror relationship to groove 1210 so as when the corner support member 1200 is articulated along axis 1240 the two walls 1230, 1231 of the horizontal V-shaped channel 1204 come into contact. Upon a slight applied pressure, the ridge 1215 and groove 1210 combination will cause the articulable corner support member 1200 to interlock in an approximate 90 degree position, therein causing the corner/edge member 1102 to remain in the interlocked position. The corner/edge support member 1200 will remain in the interlocked articulated position until a separation force is applied causing disconnection of the two substantially hollow support lobe members 1232, 1233 at the interlocking groove/ridge 1210, 1215.

Referring to FIG. 12C shows a square formed from the 3-D corner support member of FIGS. 12A and 12B. It can be seen from FIG. 12C how vertically cut V-shaped notch 1205, heat impression trough 1220, and the V-shaped longitudinal channel 1204 with base axis 1240 are cooperatively articulated to form a corner support member with an approximate 45 degree angles 1251 at each corner to form an approximate square 1250. In FIG. 12C it must be understood that to create square 1250 as shown or a rectangle (not shown) at least four vertically cut V-shaped notches 1205, four accompanying heat impression channels 1220, and one V-shaped longitudinal channel 1204 with base axis 1240 are needed. The physical relationship of side 1225 of lobe support 1232, upper surface 1235 and side surface 1226 of lobe support 1233 are depicted for visual clarity.

Figure 13A:
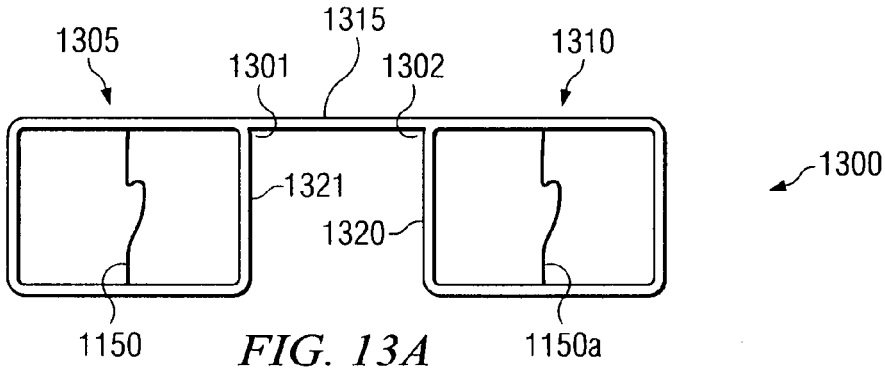
FIG. 13A is a section view of a multi-articulable corner support member according to another embodiment of the invention.
Figure 13B:
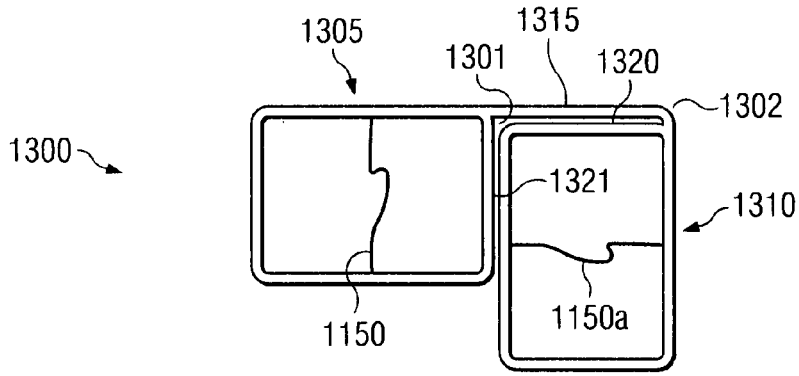
FIG. 13B is a section view of the multi-articulable corner support member of FIG. 13A after being articulated to adapt to an exemplary corner.

FIGS. 13A and 13B show an articulable corner support member 1300 in accordance with another embodiment of the present invention. The articulable corner support member 1300 shown in FIG. 13A comprises at least two substantially hollow rectangular lobe pieces 1305, 1310 formed by extrusion process of a plastic material, or the like and supported internally by wave supports 1150 and 1150*a*. The lobes 1305, 1310 comprise a linking plastic beam portion 1315 extruded so as to hingeably and resiliently attach the substantially hollow lobe pieces 1305, 1310 at opposing upper corner junction regions 1301, 1302. The intersection of corner junction region 1301 to lobe piece 1305 and corner junction region 1302 to lobe piece 1310 enable both support lobe pieces to articulate at either or both hingeable upper corner junction regions 1301, 1302 to conformably adapt to a plurality of corner and or edge surfaces.

FIG. 13B shows the corner support member 1300 of FIG. 13A after being articulated into one possible configuration. FIG. 13B depicts hollow lobe piece 1310 as having been articulated into position via hingeable upper corner junction region 1302. In this articulated position side wall 1320 of lobe 1310 will rest in hinged relation adjacent to linking plastic beam portion 1315 until re-positioned into an unarticulated position. Similarly, lobe piece 1305 can articulate at hingeable upper corner junction region 1301 so as to rest side wall 1321 adjacent to linking plastic beam portion 1315. It must be understood that lobe pieces 1305 or 1310 can be articulated in either direction (up or down) to accommodate the particular packing/shipping configuration desired. In addition, corner support member 1300 can be used in either configuration described or can be used in a multiple of different configurations as so described.

Figure 14A:
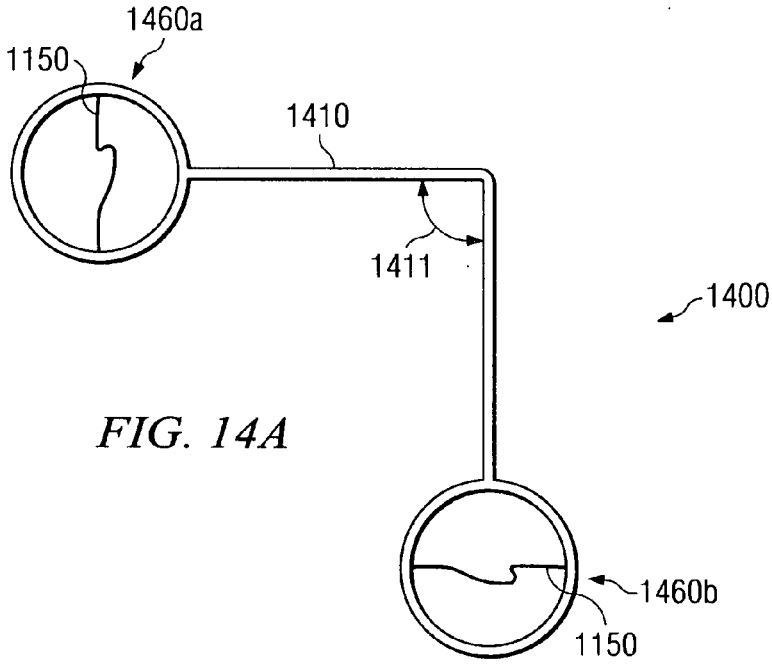
FIG. 14A is section view of an embodiment of a closed cell design corner support element member according to an embodiment of the invention.
Figure 14B:
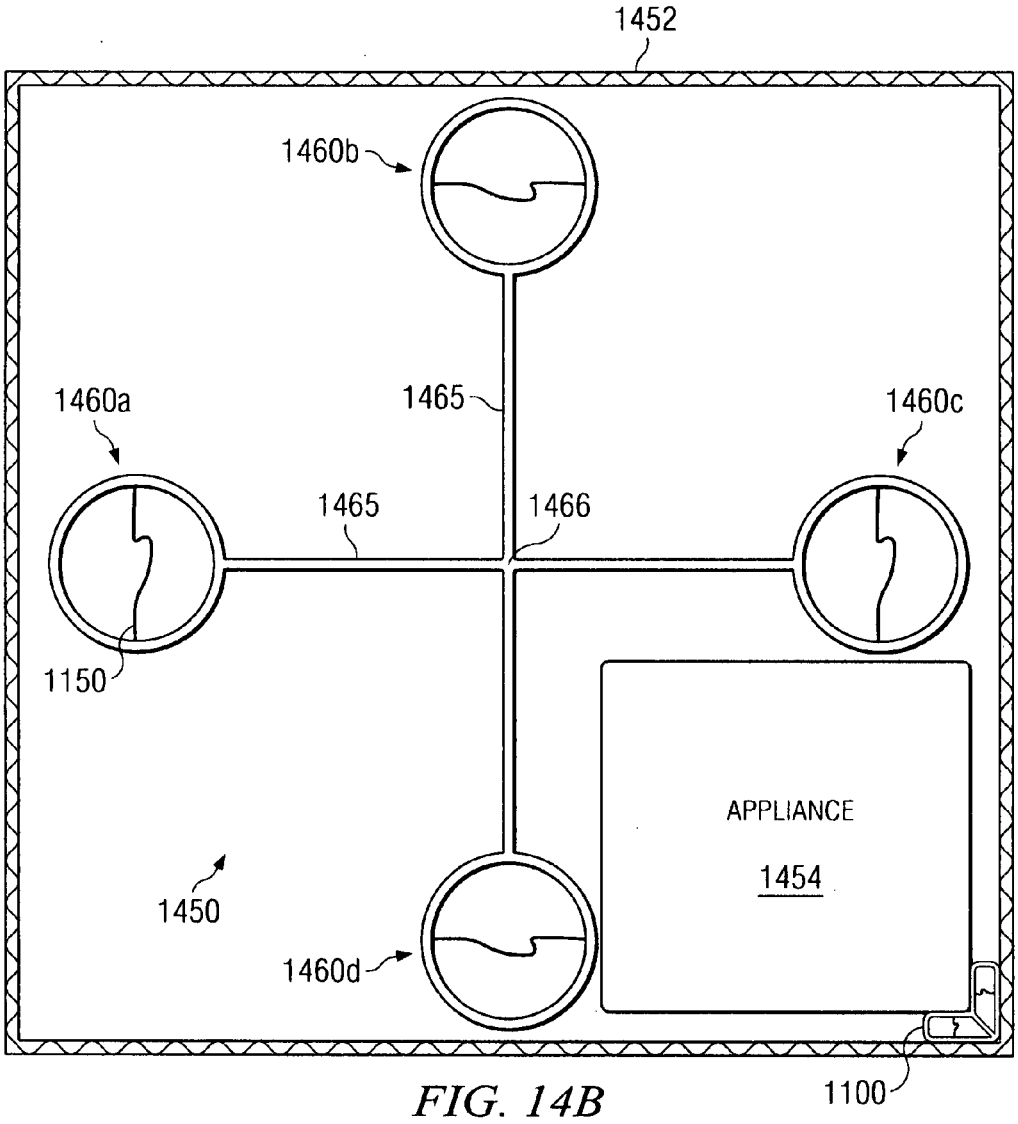
FIG. 14B is section view of an embodiment of a closed cell design interior partition support element member positioned within a corrugated box according to another embodiment of the invention.

Now referring to FIGS. 14A and 14B is depicted a section view of closed cell design element members for use in a plurality of packaging systems and configurations. The closed cell design element member 1400 of FIG. 14A comprises at least two hollow geometric shaped closed cell design elements 1460*a*, 1460*b* formed from a plastic material. The closed cells 1460 are provided internal support by wave support 1150 or the like. The closed cell design elements 1460*a*, 1460*b* are resiliently connected by rigid plastic connecting beam element 1410 and forms an approximate 90 degree angle 1411. The plastic connecting beam element 1410 provides stability and integrity of a plurality of closed cell elements 1460 while positioned in a shipping container or box.

The closed cell elements 1460*a*, 1460*b* comprise a plurality of geometric shapes, lengths and sizes to accommodate numerous packaging scenarios and various appliance shipping configurations. The generally tubular shaped closed cell design 1460 shown in FIG. 14A is not meat to delimit closed cell design shapes to that as so depicted. Closed cell design elements 1460 of a particular member can be formed having the same, different, or combination of geometric shapes on each design element member.

The closed cell element member 1450 embodiment of FIG. 14B provides a plurality of partitioned areas for safe separation and protection of a plurality of appliances 1454 while within a container or box 1452. Closed cell element member 1450 shown comprises at least four substantially hollow closed cell tubular pieces 1460*a*, 1460*b*, 1460*c*, and 1460*c* and can be provided in a plurality of lengths depending on the desired configuration (e.g., appliance/box height and/or width). The closed cell tubular pieces 1460*a-d* can be formed in a plurality of diameters, which are once again dependent on the desired packaging/shipping configuration. Each closed cell tubular design piece 1460*a-d* is attached via a rigid plastic connecting beam element 1465. The connecting beam 1465, as shown, forms four approximate 90 degree angles at their intersection 1466. The beam element 1465 configuration of FIG. 14B forms at least four partitioned areas wherein a plurality of objects can be placed for shipment or storage.

In further reference to FIG. 14B, for exemplary purposes, the articulable corner support member 1100 of FIG. 11B is shown used in combination with closed cell design element 1450. It must be understood that the formed embodiment shown in FIG. 12C can also be utilized to frame the bottom and top of appliance 1454 for further support during shipment.

Figure 15:
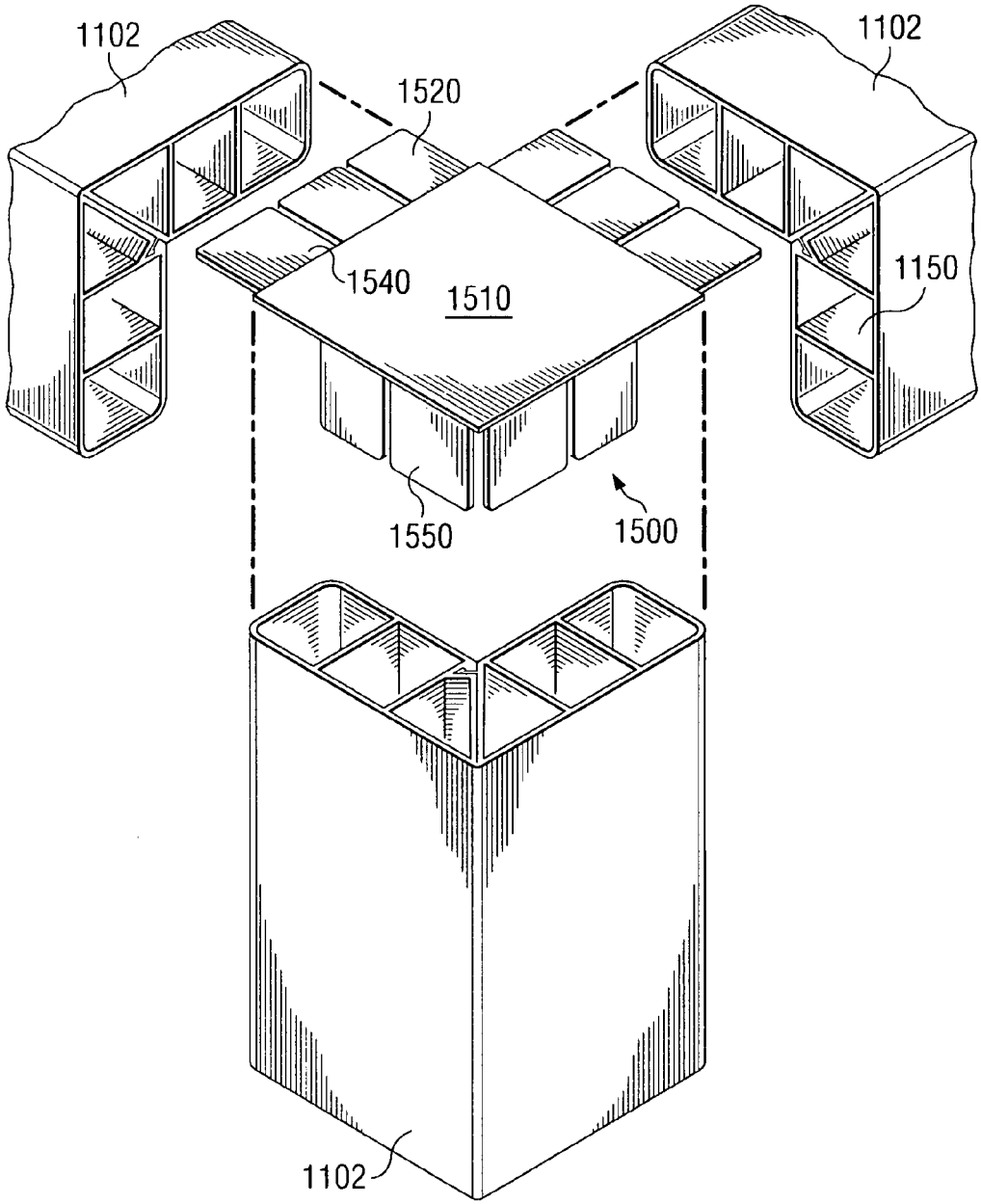
FIG. 15 is an isometric view of a joinable corner end cap with tenons in relation to the corner support members according to the invention.

Referring now to FIG. 15 is depicted an isometric view of a joinable corner end cap 1500 according to an embodiment of the invention. The corner end cap 1500 is shown in combination use with the articulable corner/edge support 1102 after being articulated and snapped into a locked hinged 3-D configuration 1102 (as shown in FIG. 11A). Joinable corner end cap 1500 comprises outer surface 1510 having a plurality of tenons 1520, 1540, 1550, and 1560 rigidly extruded in at least horizontal and vertical planes and extending therefrom.

The joinable end cap 1500 is extruded so as to removably unite the ends of fixed 816 (FIG. 8A) and articulable corner support members 1102. The end caps are formed to provide an interlocking frictional action imparted by horizontal tenon-like 1520, 1540, 1550, and 1560 extensions that protrude in planes horizontally and vertically from the end cap's exterior top surface 1510. These tenon extensions 1520, 1540, 1550, and 1560 are inserted into the hollow ends of the rigid 816 and/or articulable 1102 corner support members. When four end caps 1500 are used with support members 812 and/or 1102 a formed rectangle/square 1250 (as shown in FIG. 12C) can be rigidly and removably united. The use of the end caps 1250 ensures structural integrity of the desired formed shape 1250. The use of only one end cap 1500 with the embodiment of FIG. 12A, 12B will provide a rigid and removable union of the remaining opposing ends of the formed rectangle/square shape 1250.

Other embodiments of the invention will be apparent to those skilled in the art after considering this specification or practicing the disclosed invention. The specification and examples above are exemplary only, with the true scope of the invention being indicated by the following claims.

The invention claimed is:

1. An articulable apparatus for the packing and shipping of an object within a container comprising:

a first and a second substantially hollow support lobe member;

the first and second support lobe member resiliently connected along a hingeable base axis forming a V-shaped channel having a first and a second sidewall;

the first sidewall having a first cooperating interlocking means, forming an interlocking groove, for connection to the second sidewall; and, the second sidewall having a second cooperating interlocking means, forming an interlocking ridge hook, for connection to the first sidewall.

2. The apparatus of claim 1 wherein the interlocking groove is disposed along an upper portion of the first sidewall.

3. The apparatus of claim 2 wherein the interlocking groove extends in parallel relationship to the hingeable base along the length of its associated lobe support member.

4. The apparatus of claim 1 wherein the interlocking ridge hook is disposed along an upper portion of the second sidewall.

5. The apparatus of claim 4 wherein the interlocking ridge hook extends in parallel relationship to the hingeable base and is positioned on the second sidewall in a mirror relationship with the interlocking groove on the first sidewall.

6. The apparatus of claim 1 wherein the channel is a contoured U-shaped channel.

7. The apparatus of claim 1 wherein the channel is a square U-shaped channel.

8. The apparatus of claim 1 wherein each substantially hollow support lobe member is supported internally by at least one support member.

9. The apparatus of claim 8 wherein the at least one substantially hollow support member is a straight support member.

10. The apparatus of claim 8 wherein the at least one substantially hollow support member is a wave shaped support member.

11. The apparatus of claim 1 wherein the apparatus is adjacent a vertical corner of the object.

12. The apparatus of claim 1 wherein the apparatus is adjacent a horizontal edge of the object.

13. The apparatus of claim 1 wherein an outside angle of the apparatus lies adjacent an interior corner of the container and an inside angle of the apparatus lies adjacent an appliance corner that is to be supported and protected.

14. The apparatus of claim 1 wherein the first and second substantially hollow support lobe members are plastic.

15. The apparatus of claim 1 wherein the first and second substantially hollow support lobe members are formed through extrusion.

16. An articulable packaging apparatus for supporting an appliance in a container comprising:

a first and second substantially hollow lobe piece having a first and second corner junction region;

a linking beam resiliently hingeably connecting the first and second substantially hollow lobe pieces via the first and second corner junction regions;

the first substantially hollow lobe piece having a first interconnecting means, forming a groove, for connection to the second substantially hollow lobe piece;

the second substantially hollow lobe piece having a second interconnecting means, forming a hook, for connection to the first substantially hollow lobe piece; and, wherein the first and second substantially hollow lobe pieces are articulated into position about the corresponding corner junction region.

17. The apparatus of claim 16 wherein each substantially hollow lobe piece is supported internally by at least one straight support member.

18. The apparatus of claim 17 wherein the support member is wave shaped.

19. The apparatus of claim 16 wherein the apparatus is adjacent a set of vertical corners of the appliance.

20. The apparatus of claim 16 wherein the apparatus is adjacent a set of horizontal edges of the appliance.

21. The apparatus of claim 16 wherein an outside angle of the apparatus lies adjacent an interior corner of the container and an inside angle of the apparatus lies adjacent an appliance corner that is to be supported and protected.

22. The apparatus of claim 16 wherein the first and second substantially hollow lobe pieces are plastic.

23. The apparatus of claim 16 wherein the first and second substantially hollow lobe pieces are formed through extrusion.

24. The apparatus of claim 16 wherein the first and second substantially hollow lobe pieces can be articulated to form a plurality of angles.

25. The apparatus of claim 16 wherein the first substantially hollow lobe piece can be articulated to cause the apparatus to form a 90 degree angle.

26. The apparatus of claim 16 wherein the second substantially hollow lobe piece can be articulated to cause the apparatus to form a 90 degree angle.

27. A system for creating a packing crate for an appliance comprising:

a plurality of articulating longitudinal supports;

each of the articulating longitudinal supports comprising:

a flat base wall connected at generally right angles to a first side wall and a second side wall;

the first side wall connected to a first top wall at a generally right angle;

the second side wall connected to a second top wall at a generally right angle;

the first top wall and the second top wall being generally parallel to the flat base wall;

a first angled corner wall connected at a generally forty-five degree angle to the first top wall and the flat base wall;

a second angled corner wall connected at a generally forty-five degree angle to the second top wall and the flat base wall;

the first angled corner wall and the second angled corner wall intersecting at a generally ninety degree angle;

a first support wall and a second support wall connected between the first top wall and the flat base wall at generally ninety degree angles;

a third support wall and a fourth support wall connected between the second top wall and the flat base wall at generally ninety degree angles;

a longitudinal hook connector connected to the first angled corner wall adjacent an intersection between the first top wall and the first angled corner wall;

a longitudinal hook receiver connected to the second angled corner wall adjacent an intersection between the second top wall and the second angled corner wall;

the longitudinal hook receiver adapted to removably engage the longitudinal hook connector;

each of the articulating longitudinal supports foldable between a first flat position and a second generally right angle position;

the first flat position characterized by the flat base wall being contained in a single generally flat plane;

the second right angle position characterized by the flat base wall being contained in two generally perpendicular planes and the longitudinal hook connector engaged with the longitudinal hook receiver;

the system further comprising a corner connector;

the corner connector having a flat support surface;

a first plurality of flat connector members integrally formed with the flat support surface removably and slidably attached to a first articulating longitudinal support of the plurality of articulating longitudinal supports;

a second plurality of connector members integrally formed with the flat support surface at a generally ninety degree angle with the first plurality of flat connector members and removably and slidably attached to a second articulating longitudinal support of the plurality of articulating longitudinal supports;

a third plurality of flat connector members integrally formed with the flat support surface at a generally ninety degree angle with the first plurality of flat connector members and the second plurality of flat connector members and removably and slidably attached to a third articulating longitudinal support of the plurality of articulating longitudinal supports.

28. The system of claim 27 wherein:

the first plurality of flat connector members is in contact with the flat base wall of the first articulating longitudinal support of the plurality of articulating longitudinal supports;

the second plurality of flat connector members is in contact with the flat base wall of the first articulating longitudinal support of the plurality of articulating longitudinal supports; and the third plurality of flat connector members is in contact with the flat base wall of the first articulating longitudinal support of the plurality of articulating longitudinal supports.

29. The system of claim 27 wherein the second right angle position is further characterized by the first angled corner wall being in contact with the second angled corner wall.

30. The system of claim 27 wherein the longitudinal hook connector further comprises a triangular latch section connected to a stanchion wall and the longitudinal receiver section further comprises a triangular indention for receiving the triangular latch section.

* * * * *